United States Patent [19]

Kato et al.

[11] 4,312,257

[45] Jan. 26, 1982

[54] AUTOMATIC ACCOMPANIMENT APPARATUS

[75] Inventors: Hiroshi Kato, Ageo; Kohji Tanaka, Ora, all of Japan

[73] Assignee: Kabushiki Kaisha Kawai Gakki Seisakusho, Hamamatsu, Japan

[21] Appl. No.: 942,495

[22] Filed: Sep. 15, 1978

[30] Foreign Application Priority Data

| | | | |
|---|---|---|---|
| Sep. 24, 1977 | [JP] | Japan | 52-114956 |
| Sep. 24, 1977 | [JP] | Japan | 52-114957 |
| Oct. 1, 1977 | [JP] | Japan | 52-118334 |
| Oct. 1, 1977 | [JP] | Japan | 52-118335 |
| Oct. 7, 1977 | [JP] | Japan | 52-120685 |
| Oct. 7, 1977 | [JP] | Japan | 52-120686 |

[51] Int. Cl.[3] ..... G10F 1/00

[52] U.S. Cl. ..... 84/1.03; 84/1.24; 84/DIG. 12

[58] Field of Search ..... 84/1.01, 1.03, DIG. 22, 84/DIG. 12, 124

[56] References Cited

U.S. PATENT DOCUMENTS

| | | | |
|---|---|---|---|
| 3,854,365 | 12/1974 | Tomisawa et al. | 84/1.03 |
| 3,894,463 | 7/1975 | Rocheleau | 84/1.01 |
| 3,906,830 | 9/1975 | Mathias | 84/1.01 |
| 4,074,233 | 2/1978 | Swain | 84/1.01 |
| 4,112,802 | 9/1978 | Robinson et al. | 84/1.03 |
| 4,120,225 | 10/1978 | Dietrich | 84/DIG. 22 |
| 4,138,916 | 2/1979 | Kitagawa | 84/1.24 |

*Primary Examiner*—J. V. Truhe
*Assistant Examiner*—Forester W. Isen

[57] ABSTRACT

An automatic accompaniment apparatus which has an auto-bass circuit and an auto-arpeggio circuit. In the auto-bass circuit, note information concerning one kind of code is stored in a memory (ROM), and a code signal is detected from depressed key information in a code detector, and in a note converter a note signal from the memory is converted by the code signal to a note signal corresponding to the kind of code, whereby note signals of various kinds of codes are generated. In the auto-arpeggio circuit, note information concerning one kind of code is stored in a memory (ROM), and a code signal is detected from depressed key information in a code detector, and in a note converter a note signal from the memory is converted by the code signal to a note signal corresponding to the kind of code. The note signal is added with a root signal from the code detector, and by the added output, a scale signal is selectively obtained, which scale signal is frequency divided by an octave signal from the memory. Thus, various kinds of codes ranging over several octaves are obtained.

5 Claims, 11 Drawing Figures

AUTOMATIC ACCOMPANIMENT APPARATUS

BACKGROUND OF THE INVENTION

1. Field of the Invention

This invention relates to an automatic accompaniment apparatus which is simple in construction as an auto-bass circuit having many codes and suitable for fabrication as an integrated circuit.

2. Description of the Prior Art

The circuit structure of a conventional auto-bass or auto-arpeggio circuit is shown in FIG. 1. In FIG. 1, a chord produced by an accompaniment manual keyboard 1 and is detected by a code detector 2, which then outputs a root signal and a code signal indicative of the kind of code. For example, in the case of achieving auto-bass or auto-arpeggio accompaniment in connection with five kinds of codes each representing a chord type, such as major, minor, seventh, augment and diminish, the root signal is converted by eight encoders 3 of root, 3rd$^b$, 3rd, 5th$^b$, 5th, 6th$^b$, 6th and 7th$^b$ to signals corresponding to their degrees, respectively. On the other hand, a read pulse for reading out a read-only memory (ROM) 5 and an attack signal are derived from a rhythm pulse generator 4. The content of the ROM 5 is switched by the code signal from the code detector to the content correponding to the kind of code and read out by the read pulse from the rhythm pulse generator 4 to derive a select signal corresponding to the kind of the code. By the select signal from the ROM 5, the signal applied to a select circuit 6 from the encoder 3 are selected and sequentially applied to a tone gate 7. For example, if major is designated by the code signal, signals of root, 3rd, 5th, 6th and 7th$^b$ are selectively derived from the select circuit 6. The tone gate 7 passes therethrough scale signals in accordance with the signals selected by the select circuit 6, and the scale signals are provided to an envelope circuit 8, in which they are each amplitude controlled by the attack pulse from the rhythm pulse generator 4, thereafter being applied to a speaker 11 via a filter 9 and an amplifier 10.

With such a conventional construction, an increase in the kinds of codes used calls for a corresponding increase in the number of storage contents of the ROM 5, making it complicated and expensive. Further, the increase in the kind of codes causes an increase in the number of encoders 3, which increases the number of wirings and the number of bits of the select circuit 6, resulting in appreciably complex construction. Moreover, the prior art construction has the drawback that in the case of bass or arpeggio performance ranges over some octaves, octave control is difficult.

This invention is intended to overcome such defects of the prior art.

SUMMARY OF THE INVENTION

An object of this invention is to provide an automatic accompaniment apparatus which has an auto-bass circuit and/or an auto-arpeggio circuit which are simple in construction so that even if the kind of codes used is increased, the contents of an ROM and wirings of integrated circuits are not greatly changed.

Another object of this invention is to provide an automatic accompaniment apparatus which is provided with an auto-arpeggio circuit which is simple in construction but has many codes.

Another object of this invention is to provide an automatic accompaniment apparatus which has many codes and is free from discontinuity or interruption of an accompaniment sound during the selection of a rhythm.

Another object of this invention is to provide an automatic accompaniment apparatus with which it is possible to start arbitrary playing of a musical instrument having functions of rhythm, auto-bass and auto-arpeggio while synchronizing these functions with one another.

Still another object of this invention is to provide an automatic accompaniment apparatus which is designed to obtain an excellent musical effect when a plurality of rhythms are played at the same time.

DESCRIPTION OF THE PREFERRED EMBODIMENTS

Figure 1:
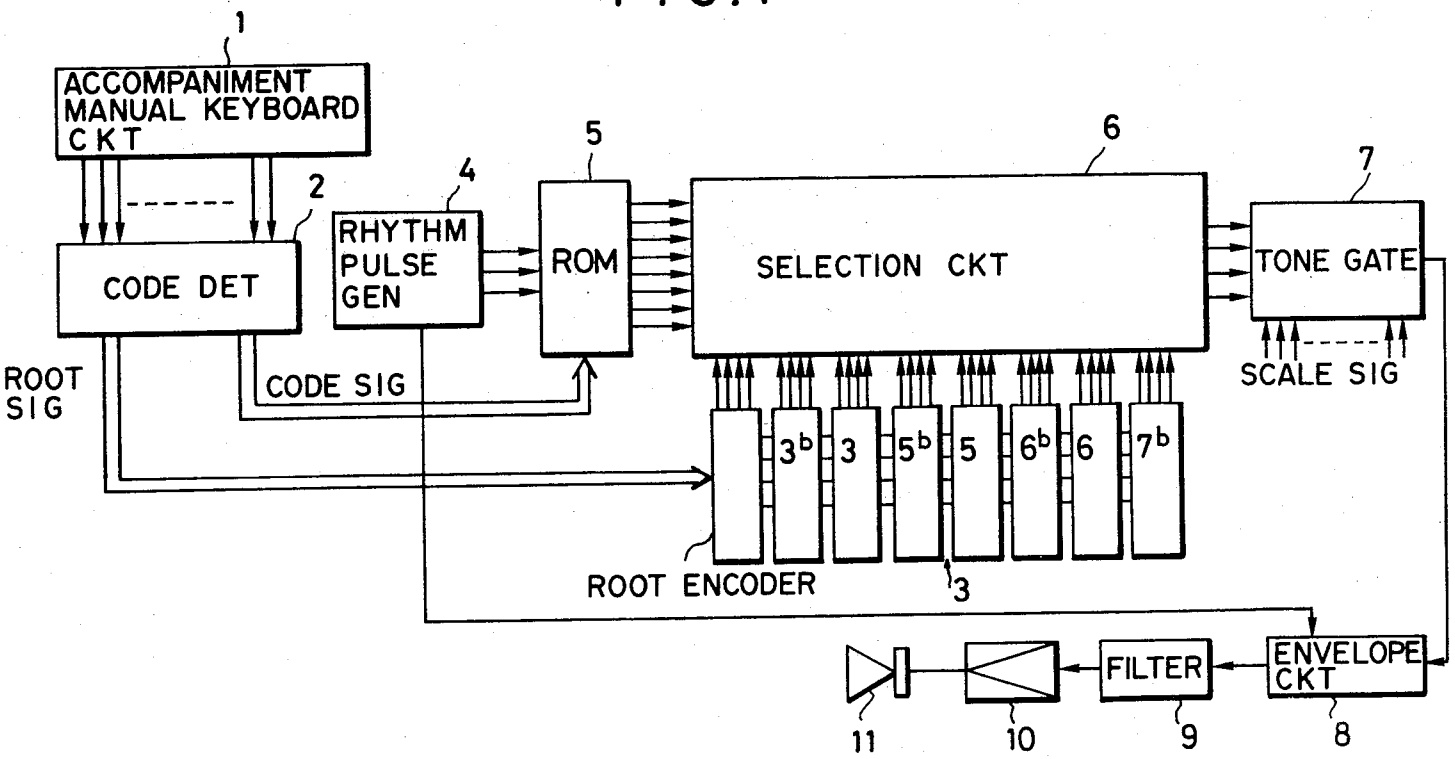
FIG. 1 shows the circuit construction of a conventional auto-bass or auto-arpeggio circuit.
Figure 2A:
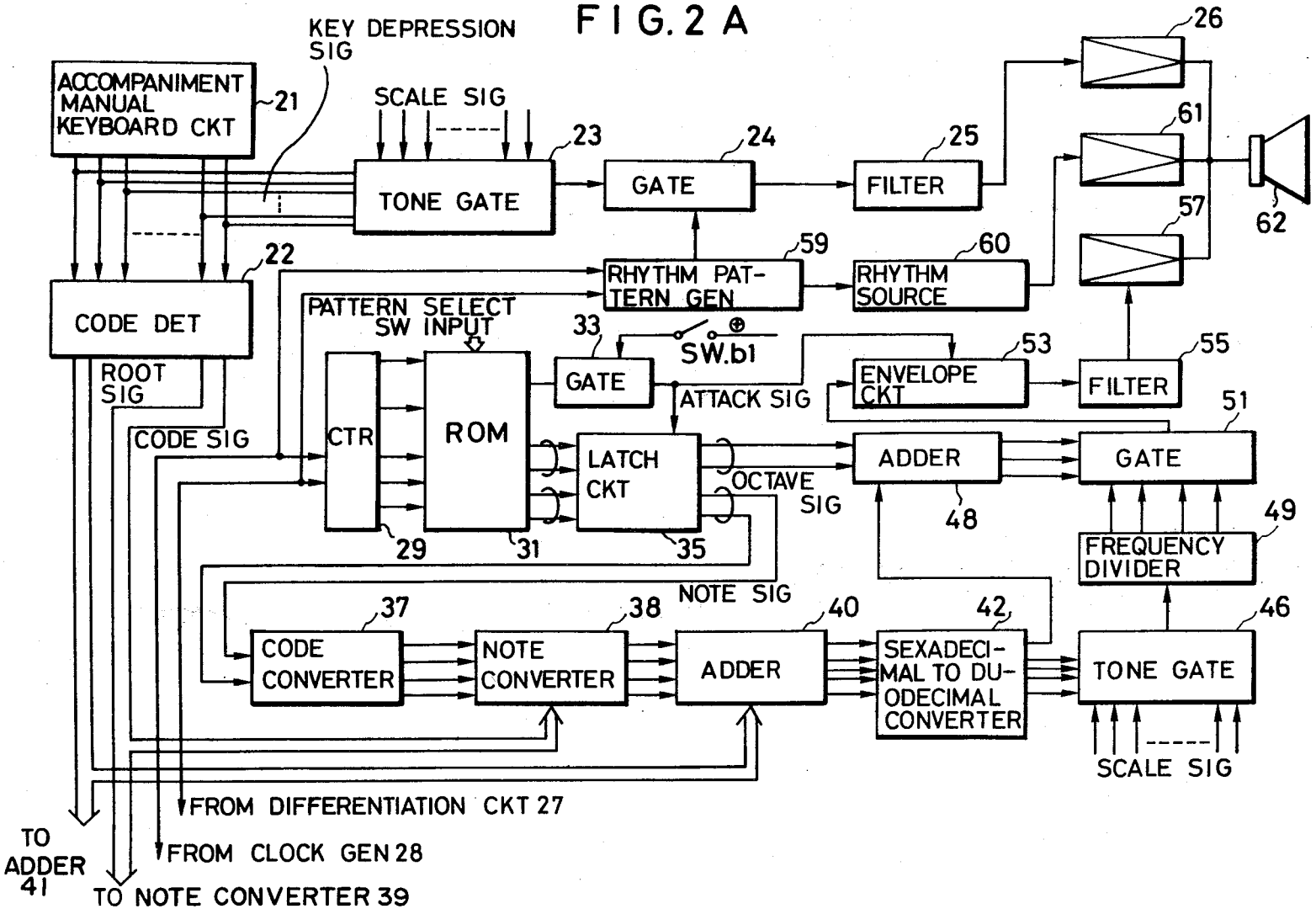
FIG. 2 is explanatory of the arrangement of FIGS. 2A and 2B illustrating in block form an embodiment of this invention.
Figure 2B:
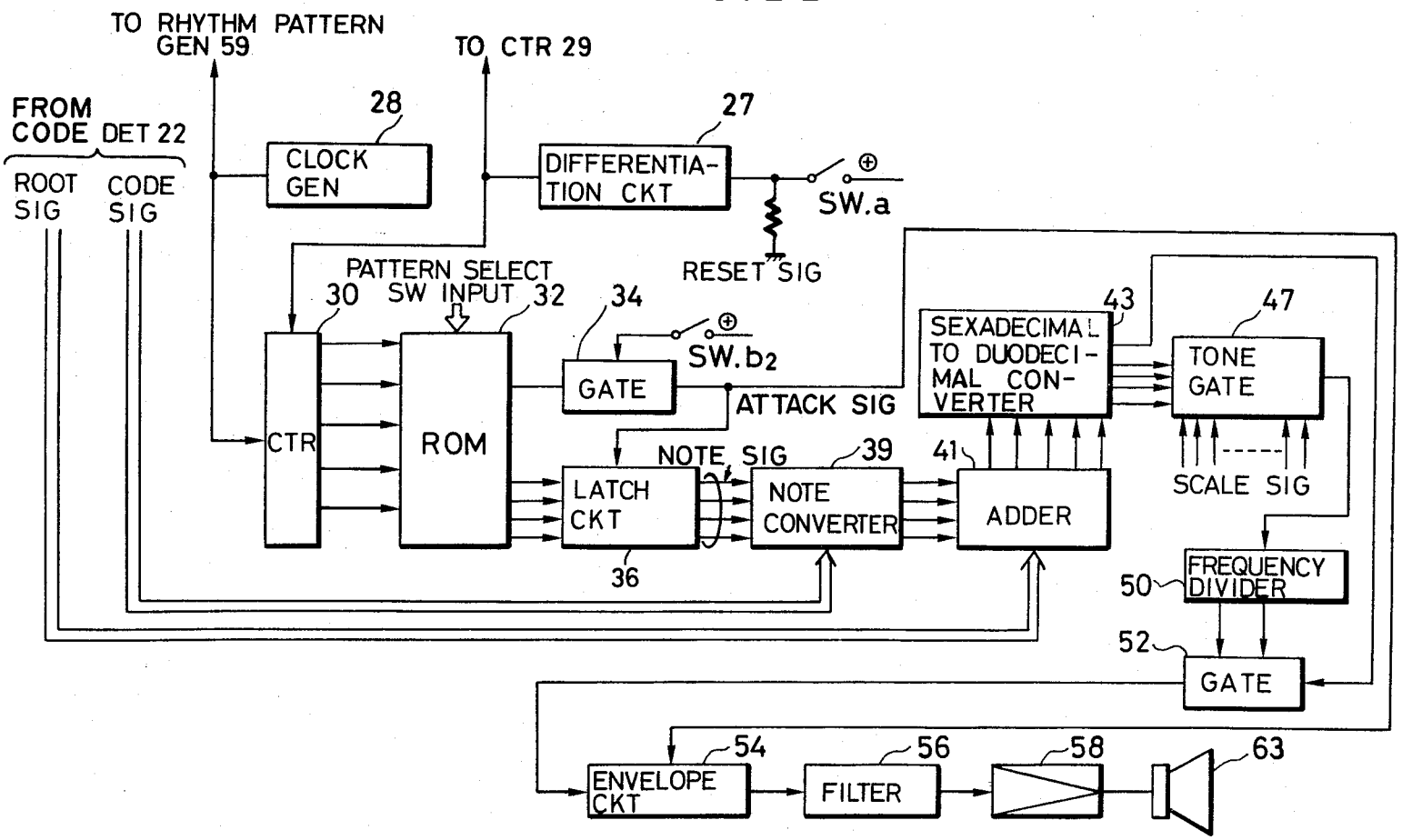

FIG. 2 shows the arrangement of FIGS. 2A and 2B, which illustrate in block form an automatic accompaniment apparatus of this invention which is composed of an auto-bass circuit and an autoarpeggio circuit similar in construction thereto.

In FIGS. 2A and 2B, when a chord is produced by an accompaniment manual keyboard in an ordinary accompaniment, a key depression signal from an accompaniment manual keyboard circuit 21 opens a tone gate 23 to permit the passage therethrough of a scale signal corresponding to a key depressed. The scale signal having passed through the tone gate 23 is provided to a gate 24, in which the scale signal is converted to a rhythm by a rhythm pulse from a rhythm pattern generator 59, thereafter being applied via a filter 25 and an amplifier 26 to a speaker 62. At the same time, the rhythm signal from the rhythm pattern generator 59 is also applied via a rhythm source 60 and an amplifier 61 to the speaker 62. On the other hand, the key depression signal is provided to a code detector 22 to detect a root and the kind of a code, which are applied to the auto-bass circuit and the auto-arpeggio circuit. The code signals relate to the quality of the bass and arpeggios, and include such qualities as major, minor, 7th, diminish, and augment. In these circuits a start switch SW.a is closed to derive a reset signal from a differentiation circuit 27, by which reset signal counters 29 and 30 and the rhythm pattern generator 59 driven by a clock generator 28 are reset for synchronous operation.

In the auto-bass circuit of the present invention, the content of an ROM 32 is read out by the output from the counter 30. The ROM 32 has stored therein an auto-bass pattern corresponding to a C major code and outputs note signals in the form of binary numbers in accordance with the pattern. Table 1 shows these note signals in the form of 4-bit binary numbers. A variety of auto-bass patterns can be selectively derived from the ROM 32 by switching its content with the input from a pattern select switch (not shown) in accordance with the kind of a rhythm, being selected, for example, samba, mambo, ballad, etc.

TABLE 1

| Note | Note signal | | | |
|---|---|---|---|---|
| C | 0 | 0 | 0 | 0 |
| C# | 0 | 0 | 0 | 1 |
| D | 0 | 0 | 1 | 0 |
| D# | 0 | 0 | 1 | 1 |
| E | 0 | 1 | 0 | 0 |
| F | 0 | 1 | 0 | 1 |
| F# | 0 | 1 | 1 | 0 |
| G | 0 | 1 | 1 | 1 |
| G# | 1 | 0 | 0 | 0 |
| A | 1 | 0 | 0 | 1 |
| A# | 1 | 0 | 1 | 0 |
| B | 1 | 0 | 1 | 1 |
| $C_H$ | 1 | 1 | 0 | 0 |

TABLE 2

| Major | Minor | Seventh | Diminish | Augment |
|---|---|---|---|---|
| C | C | C | C | C |
| E | D# | E | D# | E |
| G | G | G | F# | G# |
| A | A | A | A | G# |
| A# | A# | A# | $C_H$ | $C_H$ |
| A | A | A | A | G# |
| G | G | G | F# | G# |
| E | D# | E | D# | E |

The note signal is stored in a latch circuit 36 using an attack signal from the ROM 32 as a latch pulse. The attack signal is applied via a gate circuit 34 to the latch circuit 36 and an envelope circuit 54. In this instance, the gate circuit 34 passes therethrough the attack signal while a play switch SW.b2 is closed. That is to say, even if the start switch SW.a is closed to reset the counter 20 to read out the bass pattern from the ROM 32, no attack signal is provided to the envelope circuit 54 and no note is produced unless the play switch SW.b2 is closed. Now, the note signal stored in the latch circuit 36 is applied to a note converter 39, in which the note signal is converted by a code signal from the code detector 22 to a note signal corresponding to the kind of the code. Table 2 shows how the note signal is converted in accordance with the kind of the code with respect to the bass progress in the rhythm of swing. The note signal thus converted corresponding to the kind of the code is then applied to an adder 41 and added with the root signal from the code detector 22. The root signal is also provided in the form of a 4-bit binary number, as shown in Table 1. Table 3 shows the input-output relationship of the adder 41 in the case of the root being F "0101".

TABLE 3

| | Input | | | | | | Output | | |
|---|---|---|---|---|---|---|---|---|---|
| C | 0 | 0 | 0 | 0 | 0 | 0 | 1 | 0 | 1 |

TABLE 3-continued

| | Input | | | | | | Output | | |
|---|---|---|---|---|---|---|---|---|---|
| C# | 0 | 0 | 0 | 1 | 0 | 0 | 1 | 1 | 0 |
| D | 0 | 0 | 1 | 0 | 0 | 0 | 1 | 1 | 1 |
| D# | 0 | 0 | 1 | 1 | 0 | 1 | 0 | 0 | 0 |
| E | 0 | 1 | 0 | 0 | 0 | 1 | 0 | 0 | 1 |
| F | 0 | 1 | 0 | 1 | 0 | 1 | 0 | 1 | 0 |
| F# | 0 | 1 | 1 | 0 | 0 | 1 | 0 | 1 | 1 |
| G | 0 | 1 | 1 | 1 | 0 | 1 | 1 | 0 | 0 |
| G# | 1 | 0 | 0 | 0 | 0 | 1 | 1 | 0 | 1 |
| A | 1 | 0 | 0 | 1 | 0 | 1 | 1 | 1 | 0 |
| A# | 1 | 0 | 1 | 0 | 0 | 1 | 1 | 1 | 1 |
| B | 1 | 0 | 1 | 1 | 1 | 0 | 0 | 0 | 0 |

The 5-bit not signal added with the root signal in the adder 41 is converted by a sexadecimal-to-duodecimal converter 43 to a duodecimal number. Table 4 shows the input-output relationship of the sexadecimal-to-duodecimal converter 43. The most significant one of the five bits is carried with a numerical value 13, and this carry signal is provided to a gate 52, whereas the four lower-order bits are provided to a tone gate 47.

TABLE 4

| Input | | | | | Output | | | | | |
|---|---|---|---|---|---|---|---|---|---|---|
| 0 | 0 | 0 | 0 | 0 | 0 | 0 | 0 | 0 | 0 | C |
| 0 | 0 | 0 | 0 | 1 | 0 | 0 | 0 | 0 | 1 | C# |
| 0 | 0 | 0 | 1 | 0 | 0 | 0 | 0 | 1 | 0 | D |
| 0 | 0 | 0 | 1 | 1 | 0 | 0 | 0 | 1 | 1 | D# |
| 0 | 0 | 1 | 0 | 0 | 0 | 0 | 1 | 0 | 0 | E |
| 0 | 0 | 1 | 0 | 1 | 0 | 0 | 1 | 0 | 1 | F |
| 0 | 0 | 1 | 1 | 0 | 0 | 0 | 1 | 1 | 0 | F# |
| 0 | 0 | 1 | 1 | 1 | 0 | 0 | 1 | 1 | 1 | G |
| 0 | 1 | 0 | 0 | 0 | 0 | 1 | 0 | 0 | 0 | G# |
| 0 | 1 | 0 | 0 | 1 | 0 | 1 | 0 | 0 | 1 | A |
| 0 | 1 | 0 | 1 | 0 | 0 | 1 | 0 | 1 | 0 | A# |
| 0 | 1 | 0 | 1 | 1 | 0 | 1 | 0 | 1 | 1 | B |
| 0 | 1 | 1 | 0 | 0 | 1 | 0 | 0 | 0 | 0 | $C_H$ |
| 0 | 1 | 1 | 0 | 1 | 1 | 0 | 0 | 0 | 1 | $C_H$# |
| 0 | 1 | 1 | 1 | 0 | 1 | 0 | 0 | 1 | 0 | $D_H$ |
| 0 | 1 | 1 | 1 | 1 | 1 | 0 | 0 | 1 | 1 | $D_H$# |
| 1 | 0 | 0 | 0 | 0 | 1 | 0 | 1 | 0 | 0 | $E_H$ |
| 1 | 0 | 0 | 0 | 1 | 1 | 0 | 1 | 0 | 1 | $F_H$ |
| 1 | 0 | 0 | 1 | 0 | 1 | 0 | 1 | 1 | 0 | $F_H$# |
| 1 | 0 | 0 | 1 | 1 | 1 | 0 | 1 | 1 | 1 | $G_H$ |
| 1 | 0 | 1 | 0 | 0 | 1 | 1 | 0 | 0 | 0 | $G_H$# |
| 1 | 0 | 1 | 0 | 1 | 1 | 1 | 0 | 0 | 1 | $A_H$ |
| 1 | 0 | 1 | 1 | 0 | 1 | 1 | 0 | 1 | 0 | $A_H$# |
| 1 | 0 | 1 | 1 | 1 | 1 | 1 | 0 | 1 | 1 | $B_H$ |

In the tone gate 47 a scale signal corresponding to the four lower-order bits of the output in Table 4 is produced. The sclae signal thus obtained is frquency divided by a frequency divider 50 down to $\frac{1}{2}$ and $\frac{1}{4}$ and then applied to the gate 52. In the gate 52, the $\frac{1}{2}$ frequency-divided output and the $\frac{1}{4}$ frequency-divided output are selected by "0" and "1" of the aforesaid carry signal from the sexadecimal-to-duodecimal converter 43 and then applied to the envelope circuit 54. In the envelope circuit 54 the scale signal is amplitude controlled by the aforementioned attack signal, thereafter being provided via a filter 56 and an amplifier 58 to a speaker 63.

Next, the auto-arpeggio circuit will be described. As is the case with the auto-base circuit, an ROM 31 is read out by the output from the counter 29. The ROM 31 has stored therein arpeggio pattern corresponding to the C major code and outputs a note signal in the form of a 2-bit binary number and an octave signal in the form of a 2-bit binary number. In the case of arpeggio, the ROM 31 is capable of providing four kinds of note signals with two bits, and this is because arpeggio is usually composed of only three or four sounds forming a chord. And since arpeggio ranges over several octaves, four kinds of octave signals are prepared. A variety of arpeggio patterns can be selectively obtained by switching the content of the ROM 31 with a pattern select switch which changes the pattern in accordance with a rhythm of, for instance, mambo, swing, march, etc. The note signal and the octave signal derived from the ROM 31 are stored in a latch circuit 35 using an attack signal from the ROM 31 as a latch pulse. A gate circuit 33 passes therethrough the attack signal while a play switch SW.b1 is closed. That is, as is the case with the auto-bass, even if the start switch SW.a is closed to reset the counter 29 to read out the note signal and the octave signal of the arpeggio pattern from the ROM 31, no attack signal is applied to an envelope circuit 53 and no arpeggio performance is produced unless the play switch SW.b1 is closed. Now, the 2-bit note signal stored in the latch circuit 35 is provided to a code converter 37 and converted to three kinds of 4-bit note signals C, E and G. Further, the note signal is converted by a note converter 38 to a note signal corresponding to the kind of the code of the code signal from the code converter 22. Table 5 shows an example of the case where the 2-bit note signal is converted to the 4-bit note signal in accordance with the kind of the code.

TABLE 5

| | Major | Minor | Seventh | Diminish | Augment |
|---|---|---|---|---|---|
| 00 | 0000(C) | 0000 | 0000 | 0000 | 0000 |
| 01 | 0100(E) | 0011(D#) | 0100(E) | 0011(D#) | 0100(E) |
| 10 | 0111(G) | 0111(G) | 1010(A#) | 0110(F#) | 1000(G#) |

The note signal thus converted to the 4-bit form is applied to an adder 40, in which it is added with the root signal from the code detector 22. The adder 40 is identical with the adder 41 used in the auto-bass circuit. The 5-bit, sexadecimal note signal from the adder 40 is converted by a sexadecimal-to-duodecimal converter 42 to a 5-bit duodecimal number in the same manner as in the case of obtaining the input-output relationships shown in Table 4. The output from the converter 42 is provided to a tone gate 46 to derive therefrom a corresponding scale signal, which is frequency divided by a frequency divider 49 down to $\frac{1}{2}$, $\frac{1}{4}$, $\frac{1}{8}$ and 1/16. On the other hand, the 2-bit octave signal stored in the latch circuit 35 is applied to an adder 48, in which it is added with a carry signal of the most significant bit from the sexadecimal-to-duodecimal converter 42, and the output from the adder 48 is supplied to a gate 51. In the gate 51, the output signals from the frequency divider 49 are subjected to octave control and selectively derived. The signal having passed through the gate 51 is amplitude controlled by the attack signal in the envelope circuit 53, thereafter being applied via a filter 55 and an amplifier 57 to the speaker 62.

Figure 3:
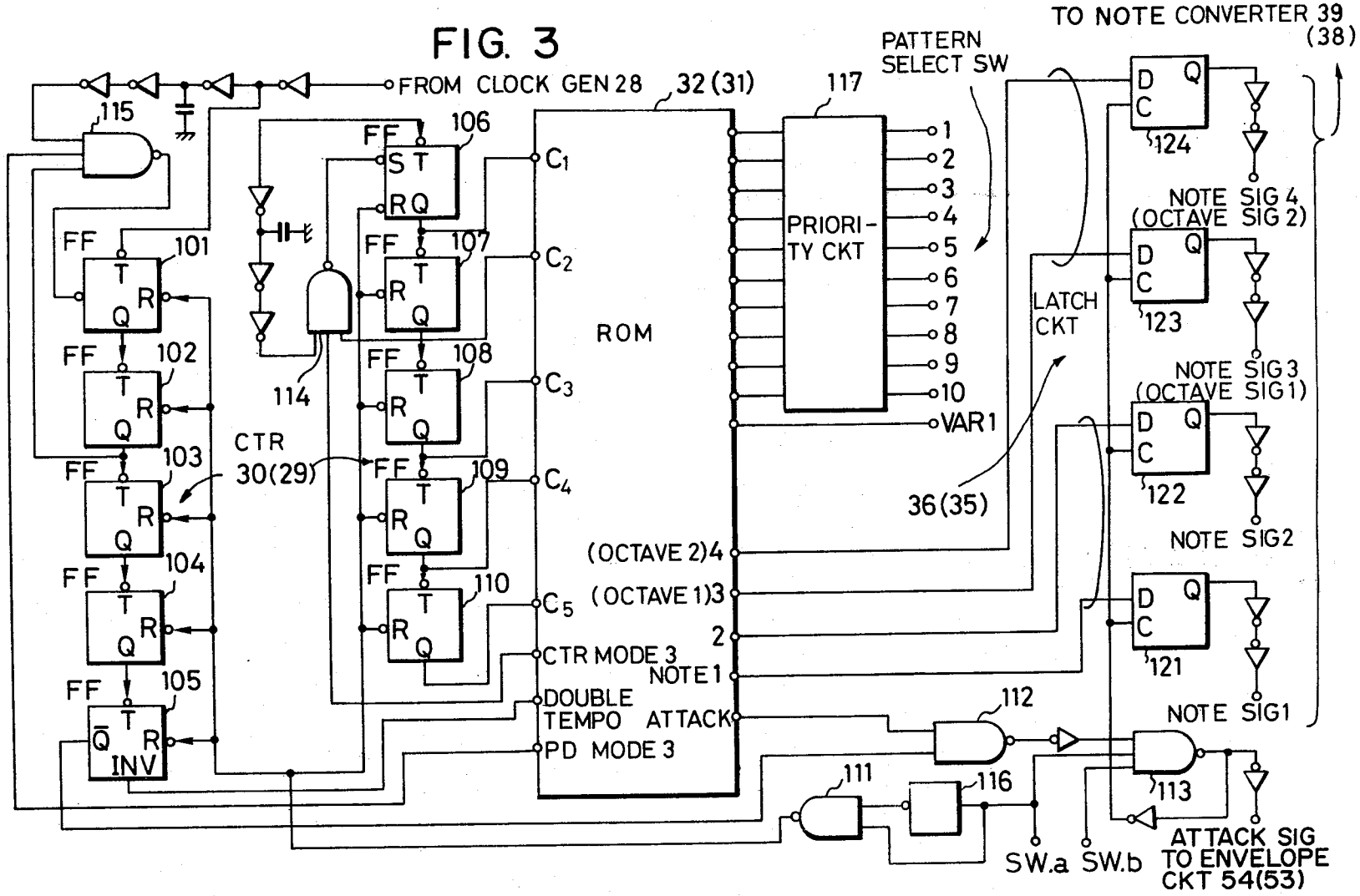
FIG. 3 illustrates specific operative circuit structures from a clock generator 28 to a latch circuit 36 in FIG. 2A and a latch circuit 35 in FIG. 2B, respectively.

FIG. 3 illustrates specific operative circuit structures from the clock generator 28 to the latch circuit 36 in the auto-bass circuit of FIG. 2B and to the latch circuit 35 in the auto-arpeggio circuit of FIG. 2A, and these circuit structures are common to the both of the auto-bass and the auto-arpeggio circuit.

Upon closing the start switch SW.a, a trigger pulse is produced by a delay circuit 116 and a NAND circuit 111, by which pulse a counter 30 (29) is reset. The counter 30(29) is divided into a first counter (flip-flops 101 through 105) and a second counter flip-flops 106 through 110). The counter 30(29) reads out the content of the ROM 32(31) with Q outputs $C_1$ through $C_5$ from the flip-flops of the second counter to derive at output terminals 4-bit note signals (1–4) and an attack signal in the case of the auto-bass and 2-bit note signals (1, 2), 2-bit octave signals (1,2) and an attack signal in the case of the auto-arpeggio. The note signals (1–4) or the note signals (1,2) and the octave signals (1,2) are provided to the latch circuit 36(35), that is, D terminals of D flip-flops 121 through 124, and if the play switch SW.b is closed, the attack signal is inverted by NAND circuits 112 and 113 and applied as a latch signal to a C terminal of each of the D flip-flops 121 through 124, by which the note signals or octave signals at the D terminals are stored and then applied to the note converter 39(38) of the next stage. The attack signal is provided via the NAND circuit 113 to the envelope circuit 54(53). At pattern select switch terminals, the kinds of rhythms, for example, rock, waltz, mambo, swing, ballad, etc. are designated. A priority circuit 117 is provided to determine the priority levels of such rhythms when they are designated at the same time. In response to the rhythms being designated, the states of terminals CTR (address counter) mode 3, double tempo and PD (predivider) mode 3 of the ROM 32 (31) change. For instance, in the case of rock being designated, the PD mode 3 becomes "1", which is applifed via a NAND circuit 115 to the first counter to put it in a ternary mode of operation; in the case of swing, the CTR mode 3 becomes "1", which is applied via a NAND circuit 114 to the second counter to put it in the ternary mode of operation; and in the case of waltz, the PD mode 3 and the CTR mode 3 become "1" to put the first and second counters in the ternary mode of operation. Further, in response to the rhythm being designated, the double tempo becomes "1" to cause the flip-flop 105 to serve as an inverter. Table 6 shows one example of the count number of one pattern of the first and second counters in the pattern selection corresponding to each rhythm.

TABLE 6

| | Auto-Bass | | | Auto-Arpeggio | | |
|---|---|---|---|---|---|---|
| Rhythm | First counter | Second counter | Number of bars forming one pattern | First counter | Second counter | Number of bars forming one pattern |
| Waltz | 24 | 24 | 4 | 12 | 24 | 2 |
| March | 12 | 32 | " | 6 | 32 | " |
| Rumba | " | " | 2 | 12 | " | " |
| Bossa nova | " | " | " | " | " | " |
| Samba | " | " | " | " | " | " |
| Mambo | " | " | " | " | " | " |
| Cha-Cha | " | " | " | " | " | " |
| Rock (1) | " | " | " | " | " | " |
| Rock (2) | " | " | " | " | " | " |
| Rock (3) | " | " | " | " | " | " |
| Beguine | " | " | " | " | " | " |
| Tango | " | " | " | " | " | " |
| Ballad | 16 | 24 | 1 | 8 | 24 | 1 |

TABLE 6-continued

| Rhythm | Auto-Bass First counter | Auto-Bass Second counter | Auto-Bass Number of bars forming one pattern | Auto-Arpeggio First counter | Auto-Arpeggio Second counter | Auto-Arpeggio Number of bars forming one pattern |
|---|---|---|---|---|---|---|
| Swing (1) | " | " | 2 | 16 | " | 2 |
| Swing (2) | " | " | " | " | " | " |
| Swing (3) | " | " | " | " | " | " |

Since there are provided two control means, that is, the start switch SW.a and the play switch SW.b, as described above, it is possible to achieve synchronous operation of the rhythm pattern generator, the auto-bass circuit and the auto-arpeggio circuit with the start switch SW.a and then derive a note from a desired circuit with the play switch SW.b. Moreover, since the latch circuit 36(35) is provided at the output of the ROM 32(31), there is no possibility that even in the case of selecting a new rhythm or even if automatic playing is stopped, the sound being played does not change or sustain does not break.

Next, a specific operative example of the note converter 39 in the auto-bass circuit (see FIG. 2B) will be outlined.

Figure 4:
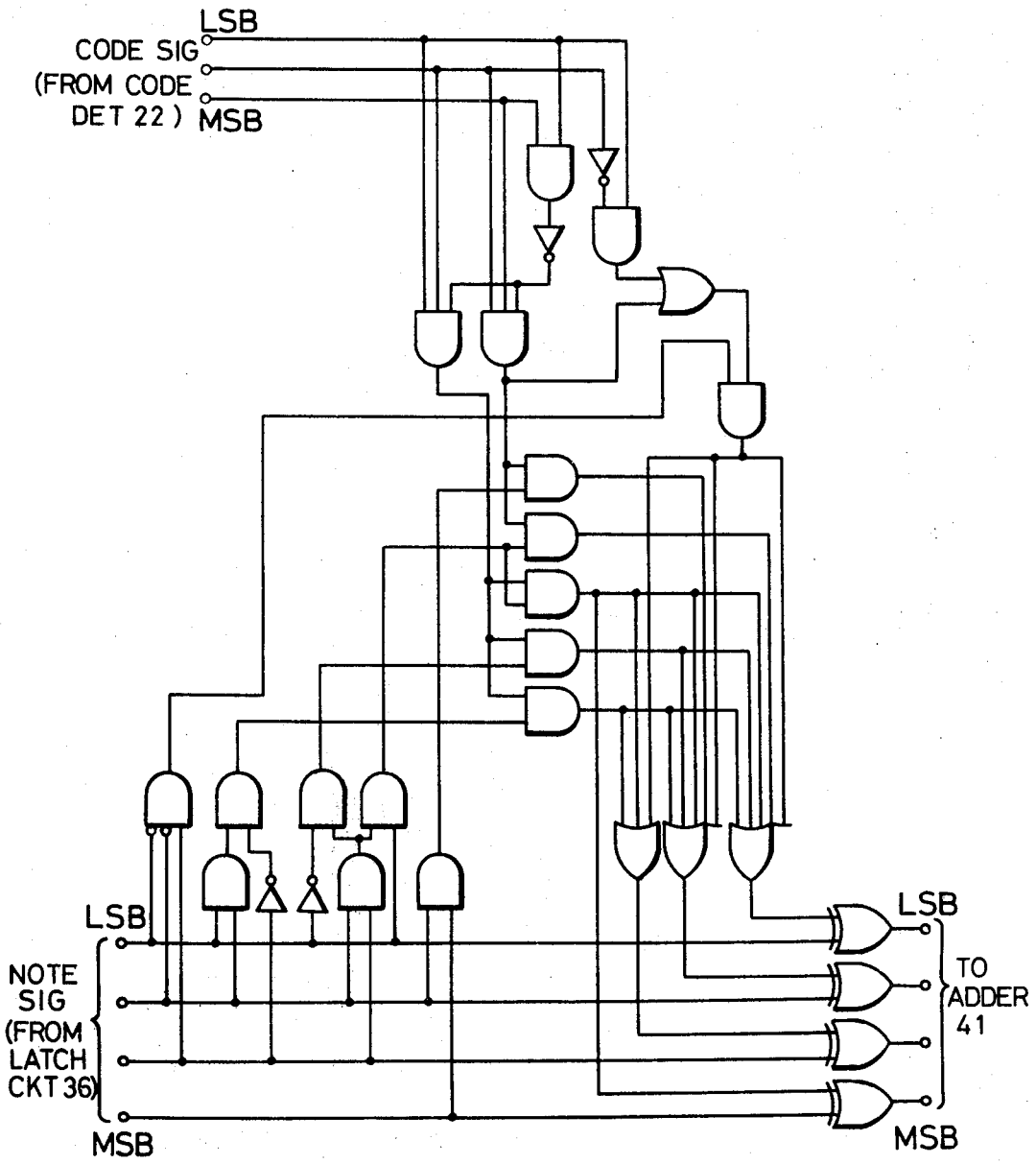
FIG. 4 shows a specific operative circuit of a note converter 39 in FIG. 2B.

By a logic circuit shown in FIG. 4, the 4-bit note signal stored in the latch circuit 36 is converted to a note signal corresponding to the code signal from the code detector 22. When the code signal is "000" (major) or "010" (seventh), the note signal from the latch circuit 36 is applied, as it is, to the adder 41. When the code signal is "001" (minor), if "0100" (E) is applied to the note converter 39, it is converted to "0011" (D#). In this manner, note conversion is carried out in accordance with Table 2.

Figure 5A:
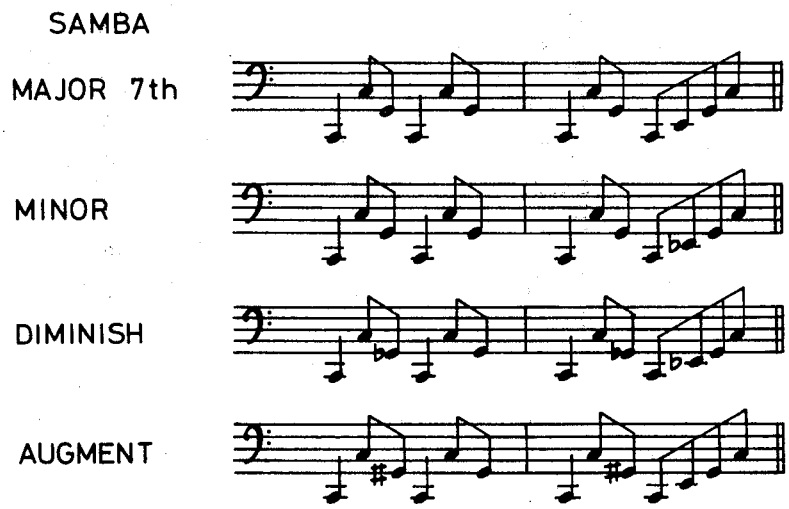
FIGS. 5A and 5B respectively show rhythms of samba and ballad which are examples of note-converted bass patterns.
Figure 5B:
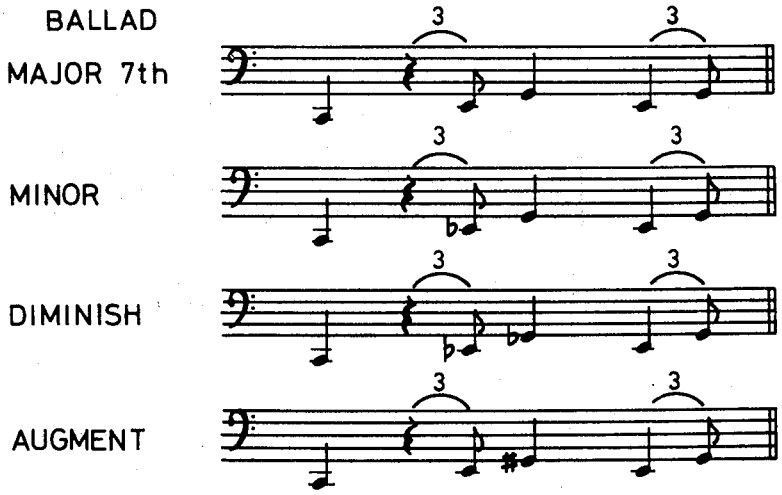

Thus, for example, in the case of the rhythms of samba and ballad, bass patterns such, for instance, as shown in FIGS. 5A and 5B are obtained in accordance with the kinds of codes. The note-converted note signal is applied via the adder 41 and the sexadecimal-to-duodecimal converter 43 to the tone gate 47 to derive therefrom a scale signal corresponding to the note signal, as is the case with the auto-arpeggio.

As described above, according to the auto-bass circuit of this invention, note information on one kind of code is stored in a memory circuit (ROM), and a code signal is detected by a code detector from depressed key information, and a note signal from the memory circuit is converted by a note converter to a note signal corresponding to the kind of code of the code signal from the code detector. In this manner, note signals of various kinds of codes can be produced. In this case, even if the number of codes is increased, it is sufficient only to slightly change the note converter and like circuits while holding the content of the ROM and the number of wirings substantially unchanged, so that the auto-bass circuit of this invention can be simplified in construction and can be easily fabricated as an integrated circuit. The same is true of the auto-arpeggio circuit described above by way of example. Further, in the case where the both circuits are fabricated as integrated circuits, they can be produced in the common system.

Moreover, since use is made of the method of adding together four bits of the note signal and four bits of the root signal by means of an adder, octave control can be easily achieved by a carry signal which is generated by the addition.

Figure 6A:
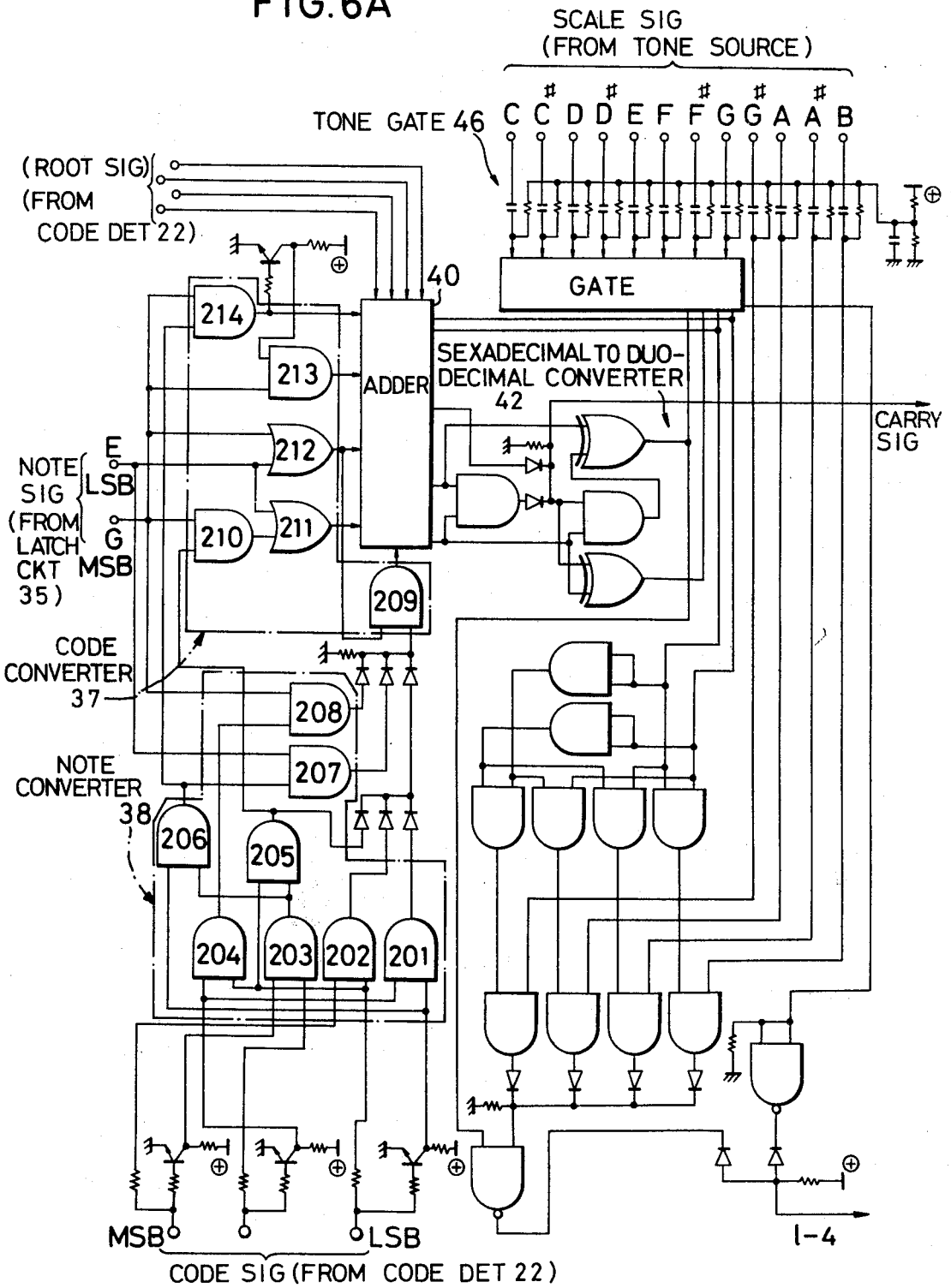
FIGS. 6A and 6B illustrate specific operative circuit structures from a code converter 37 to an envelope circuit 53 in the auto-arpeggio circuit shown in FIG. 2A.
Figure 6B:
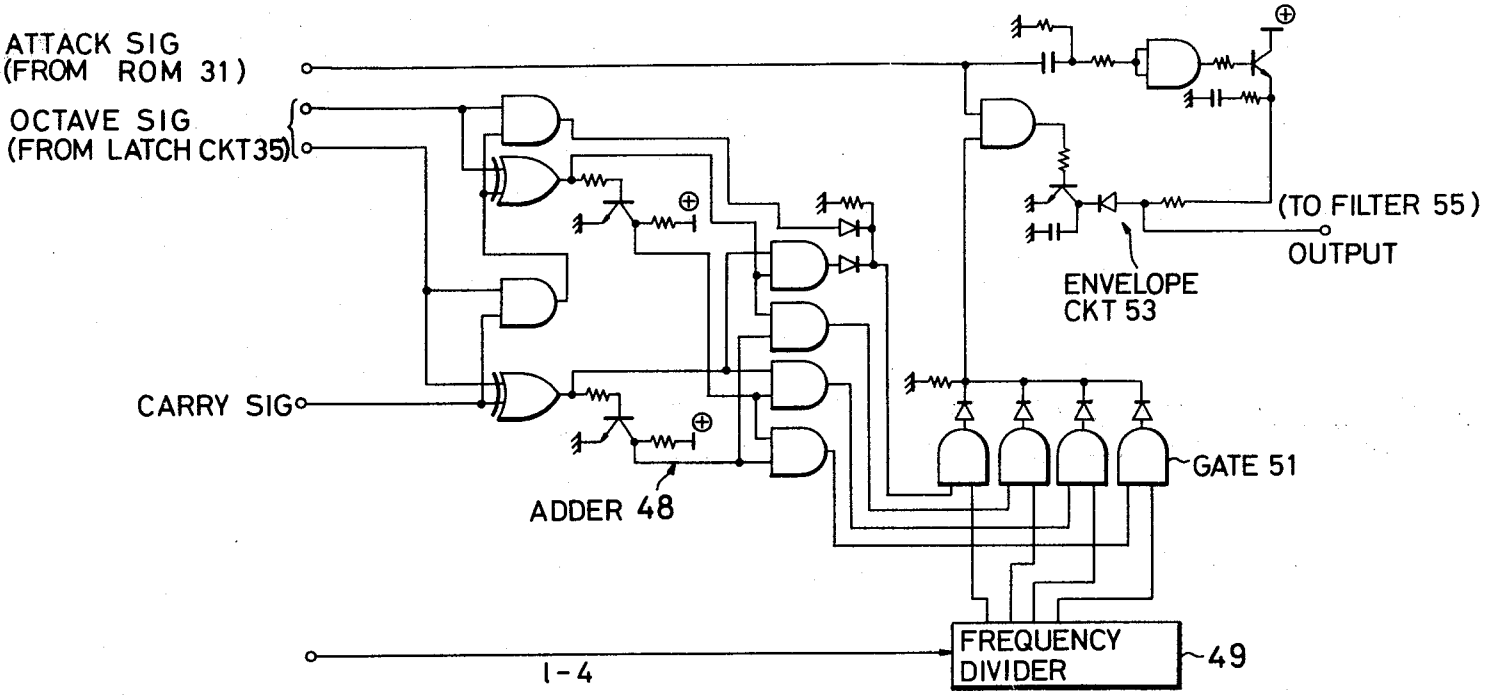

FIG. 6 illustrates a specific operative circuit structures from the code converter 37 to the envelope circuit 55 in the auto-arpeggio circuit 53 (see FIG. 2A). The 2-bit note signal stored in the latch circuit 35 is provided to the code converter 37 composed of logic circuits 209 through 214 and the note converter 38 similarly composed of logic circuits 201 through 208. The 3-bit code signal, shown in Table 7, is applied from the code detector 22 to the note converter 38. As a result of this, the 2-bit note signal is converted by the 3-bit code signal to a 4-bit note signal corresponding to the kind of codes shown in Table 5. And in the adder 40, the 4-bit note signal is added with the root signal from the code detector 22 to provide a note signal of a 5-bit sexadecimal number is converted by the sexadecimal-to-duodecimal converter 42 to a signal of a duodecimal number, which is applied to the tone gate 46 to control it.

TABLE 7

| Code signal | | | Kinds of codes |
|---|---|---|---|
| 0 | 0 | 0 | major |
| 0 | 0 | 1 | minor |
| 0 | 1 | 0 | seventh |
| 1 | 1 | 0 | diminish |
| 0 | 1 | 1 | augment |
| 1 | 1 | 1 | (error) |

Assuming that note signals "00", "01" and "10" are sequentially applied from the latch circuit 35, that major "000" is applied as the code signal from the code detector 22 and that the root signal from the code detector 22 is "0000" (note C), the following operations are performed. Since the code signal is "000", the output from the AND circuit 201 is "1", but the outputs from the AND circuits 202, 203, . . . 208 are "0". Accordingly, when the note signal is "00", the outputs from the OR circuits 211 and 212 and the AND circuits 213 and 214, which are applied to the adder 40, are all "0", and the output from the AND circuit 209, which is the carry input, is also "0", with the result that the input to the adder 40 is "0000" (note C). Next, when the note signal is "01", the outputs from the OR circuits 211 and 212 become "1", and the output from the AND circuit 209, which is the carry input, becomes "1", so that "1" is added to "0011" and hence "0100" (note E) is applied to the adder 40. In the case of the note signal being "10", the outputs from the AND circuit 213 and the OR circuit 212 become "1" and the output from the AND circuit 209 which is the carry input also becomes "1", so that "1" is added to "0110" and hence "0111" (note G) is applied to the adder 40.

The above correspondes to major "0000" in Table 7. Also with respect to the other codes, the aforesaid AND circuits 201 through 208 are set to provide predetermined logical outputs in accordance with code signals of minor, seventh, diminish, augment and (error), and the outputs are combined with respective note signals, and the 2-bit note signals are each converted to a 4-bit note signal in accordance with the kind of the code in the same manner as described above.

The 4-bit note signal thus converted in accordance with the kind of the code is added with the 4-bit root signal from the code detector 22 and provided as a note signal of a 5-bit sexadecimal number to the sexadecimal-to-duodecimal converter 42, in which it is converted to a duodecimal number by logic circuits embodying the principles of Table 4. Then, the four lower-order bits of the 5-bit output are applied to the tone gate 46 to control it to select one of the scale signals C to B from a tone source corresponding to the note signal and provide the selected scale signal onto a line 1-4. On the other hand, the carry signal of the most significant bit of the 5-bit output from the sexadecimal-to-duodecimal converter 42 is sent to the adder 48 for addition with an octave signal. That is, the 2-bit octave signal stored in the latch circuit 35 is passed through a parallel circuit of an exclusive OR circuit and an AND circuit for addition, and by the output therefrom, the gate 51 is controlled. The scale signal provided onto the line 1-4 from the tone gate 46 is applied to the frequency divider 49, in which it is frequency divided at four stages corresponding to the octave, and the outputs from the respective stages are selectively derived at the gate circuit 51 in accordance with the output from the adder 48. The scale signal thus selectively derived is applied to the envelope circuit 53 and amplitude controlled by the attack signal from the ROM 31, and as a consequence, a scale signal of an envelope waveshape is provided to the filter 55.

As described above, according to the auto-arpeggio circuit of this invention, note information concerning one kind of code is stored in a memory circuit (ROM), and on the other hand, a code signal is detected from depressed key information in a code detector, and in a note converter, the note signal from the memory circuit is converted by the code signal from the code detector to a note signal corresponding to the kind of the code. The note signal thus obtained is added with a root signal from the code detector, and by the added output, a scale signal is selectively provided, and is then controlled by frequency division with an octave signal from the memory circuit.

In this manner, a variety of codes ranging over several octaves can be readily obtained. In this case, even if the kind of codes is increased, it is sufficient only to slightly modify the note converter and the like while maintaining the content of the ROM and the number of wirings substantially unchanged; therefore, the circuit of this invention can be simplified in construction and readily fabricated as an integrated circuit. The same is true of the auto-bass circuit described above in connection with the embodiment of this invention. When the auto-arpeggio and the auto-bass circuit are fabricated as integrated circuits, they can be produced in a common system in which the ROM output is made a 4-bit binary number composed of a 2-bit note signal and a 2-bit octave signal and output terminals are provided for a 4-bit binary number of the auto-bass circuit and only a mask is changed.

Further, since use is made of such a method that converts the 2-bit note signal to a 4-bit signal and adds the 4-bit note signal with the 4-bit root signal, octave control can be easily effected by a carry signal resulting from the addition, and the addition with the initial octave signal can also be achieved with a simple construction.

Figure 7:
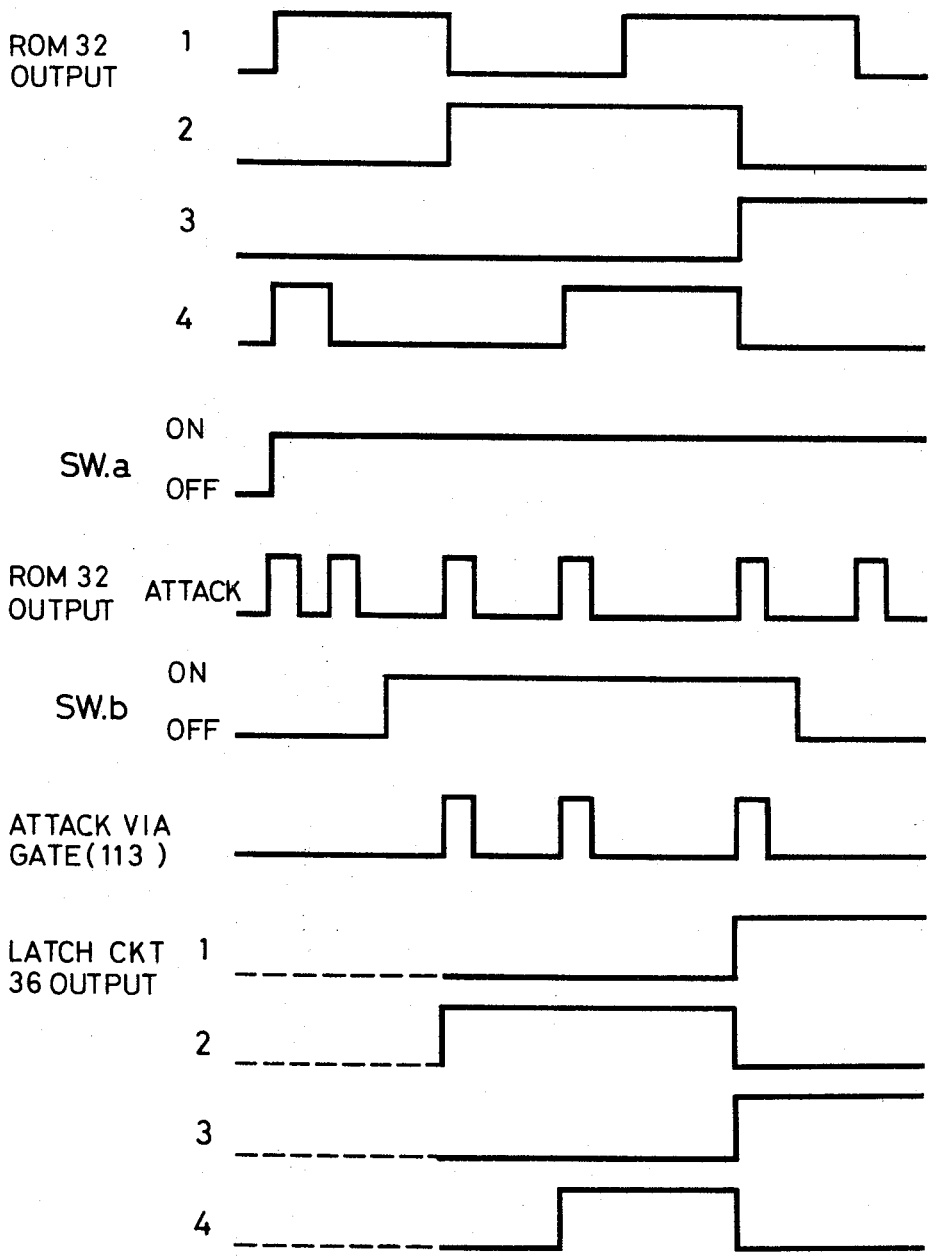
FIG. 7 shows timing charts of the input and output of the latch circuit 36(35) depicted in FIGS. 2A and 2B, respectively.

FIG. 7 shows a series of timing charts of the input and output of the latch circuit 36(35) depicted in FIGS. 2A and 2B. With reference to FIG. 7, the operation of the latch circuit 36 will be described in brief. Now, let it be assumed that, for example, in the case of the waveform of the 4-bit note signal (1-4) from the ROM 32 and an attack signal corresponding thereto, the start switch SW.a and the play switch SW.b are turned ON at the moments illustrated in FIG. 7. As a result of this, the output (1-4) from the latch circuit 36 stores the 4-bit note signal (1-4) from the ROM 32 with the attack signal occurring after turning ON of the play switch SW.b and maintains the note signal until the next attack signal occurs. This ensures to prevent that accompaniment breaks in the midst of a tune being played.

As described above, according to this invention, a latch circuit is provided at the output side of a memory circuit (ROM), and a note signal is stored in the latch circuit with an attack signal from the memory circuit. As a consequence, even if the note signal sent to the note converter from the memory circuit is temporarily interrupted as by the selection of a new rhythm, the immediately preceding note signal is stored in the latch circuit and continuously sent out until the next attack signal is applied, so that the accompaniment sound is neither interrupted nor changed, and natural accompaniment is achieved.

In the above, this invention has been described as being applied to an automatic accompaniment apparatus composed of the auto-bass circuit and the auto-arpeggio circuit, but the invention is applicable to any automatic accompaniment apparatus of the type in which a scale signal corresponding to a note signal from a memory circuit is obtained and added with an envelope by an attack signal and then converted to a tone signal. Further, the principal part of the present invention is the latch circuit, but it may also be replaced with a register or the like which has the same function as the latch circuit.

As set forth above, according to this invention, in a plurality of automatic accompaniment circuits in each of which a note signal and an attack signal stored in a memory circuit are outputted therefrom in accordance with the output from a counter counting clocks, the note signal from the memory circuit is applied to a gate circuit to derive therefrom a corresponding scale signal, the scale signal is applied to an envelope circuit for amplitude control with the attack signal and the output from the envelope circuit is converted by a tone converter to a tone signal, all the counters of the plurality of automatic accompaniment circuits are started in synchronism by a first switching circuit for resetting the counters in common to them, and then each automatic accompaniment circuit is started to play by a second switching circuit provided in a circuit for supplying the attack signal from the memory circuit to the envelope circuit in each accompaniment circuit. Accordingly, even in the case where an electronic musical instrument having an auto-bass, an auto-arpeggio and an automatic rhythm performance circuit is played in such a manner that, for example, at the start of a tune, only a rhythm is played by the automatic rhythm performance circuit, and bass is played by a pedal keyboard, in the midst of the tune, the bass is switched to the auto-bass circuit and then at a climax of the tune the auto-arpeggio inserted, the synchronization of the automatic accompaniment circuits does not become out of step since the counters provided in the respective automatic accompaniment circuits are always synchronized with one another. Moreover, the passage of the attack signal is controlled by the play switch, so that even where a tone is sustained, there is no possibility of the tone being interrupted by turning OFF of the play switch.

Figure 8:
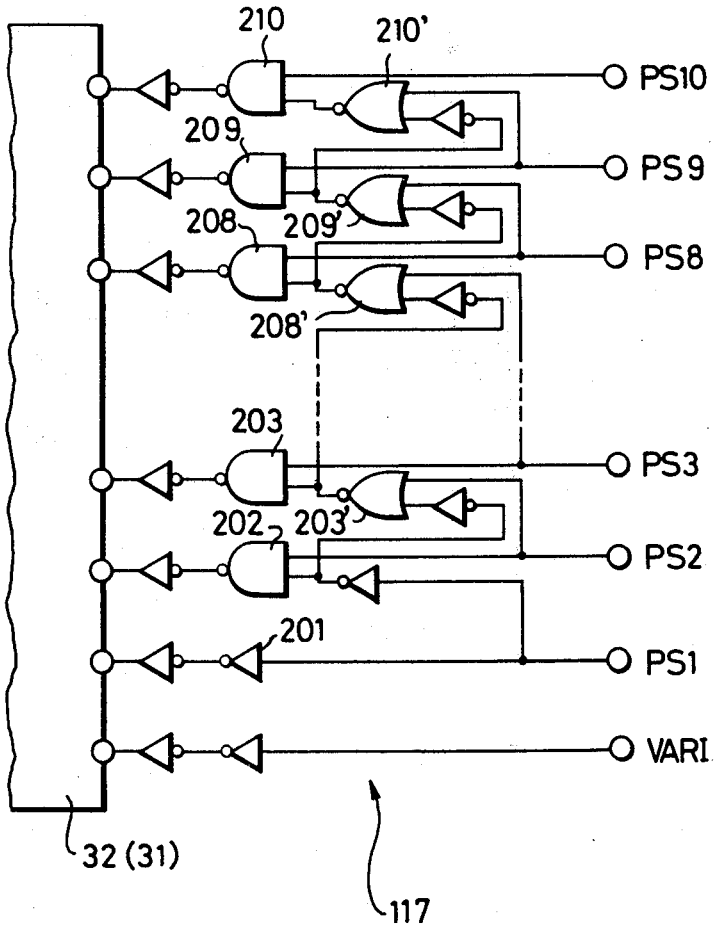
FIG. 8 illustrates a specific operative example of a priority circuit 117 utilized in FIG. 3.

FIG. 8 shows a specific operative example of the priority circuit 117 utilized in FIG. 3. Ten pattern select switches PS1 through PS10 are connected via the priority circuit 117 to the ROM 32(31), and one non-priority switch VARI is connected directly to the ROM 32(31). Assuming that the pattern select switches PS1 to PS3 are turned ON at the same time, the switch PS1 is set to "1", which is inverted by a NOT circuit 201, and "1" is applied to the ROM 32(31). Next, an inverted input "0" of the switch PS1 and the input "1" of the switch PS2 are inverted by a NAND circuit 202, applying "0" to the ROM 32(31). Then, the input "1" of the switch PS2 and the input "1" of the switch PS1 are applied to a NOR circuit 203', and its output "0" is applied to a NAND circuit 203 together with the input "1" of the switch PS3 and is inverted thereby, applying "0" to the ROM 32(31). The above operations are achieved also in the case where the switches PS1 and PS3 are simultaneously turned ON, with the switch PS2 held in the OFF state. The priority of the switches is PS1>PS2>. . . . >PS9>PS10.

Accordingly, in the case where a plurality of rhythms are designated simultaneously in the auto-bass or the auto-arpeggio circuit, patterns of note signals are selectively provided in accordance with the predetermined priority, ensuring to produce an effect which is excellent musically.

According to this invention described above, in the case where there are provided pattern select switches for selecting rhythm patterns of note signals from the memory circuit (ROM), even if a plurality of rhythms are selected at the same time, a priority circuit provided between the select switches and the memory circuit ensures that only one pattern is selected in each of the auto-bass circuit and the auto-arpeggio circuit, producing a musically favorable effect.

It will be apparent that many modifications and variations may be effected without departing from the scope of the novel concepts of this invention.

What is claimed is:

1. An automatic accompaniment apparatus which is provided with an auto-bass circuit comprising a code detector for detecting both root signal, and a code signal representing the chord type of the bass pattern to be produced from depressed key information derived from a keyboard circuit to output both the root signal and the code signal in the form of binary numbers, a memory circuit for storing note information, representing rhythm patterns in one root key and one chord type and sequentially outputting note signals of the note information in the form of binary numbers in accordance with the output from a counter directly connected to the memory circuit, a note converter receiving the note signals from the memory circuit and the code signal from the code detector and converting each of the note signals from the memory circuit by the code signal from the code detector to a note signal corresponding to the kind of the code of the code signal, an adder for adding to the output from the note converter the root signal from the code detector, and a tone converter for converting the output from the adder to a tone signal.

2. An automatic accompaniment apparatus which is provided with an auto-arpeggio circuit comprising a code detector for detecting both a root signal and a code signal, representing the chord type of the arpeggio, from depressed key information derived from a keyboard circuit to output both the root signal and the code signal in the form of binary numbers, a memory circuit for storing note information, representing rhythm patterns in one root and one chord type, and octave information associated therewith and sequentially outputting note signals of the note information and octave signals of the octave information in accordance with the output from a counter directly connected to the memory circuit, a note converter receiving the note signals and the octave signals from the memory circuit and the code signals from the code detector and converting each of the note signals from the memory circuit by the code signal from the code detector to a note signal corresponding to the kind of code of the code signal, an adder for adding to the output from the note converter the root signal from the code detector, means for seletively obtaining a scale signal from the output of the adder and frequency dividing the scale signal with the octave signal from the memory circuit, and a tone converter for converting the output from the frequency dividing means to a tone signal.

3. An automatic accompaniment apparatus according to claim 2, wherein there is provided means for outputting the note signal from the memory circuit in the form of a binary number with two bits.

4. An automatic accompaniment apparatus comprising a memory circuit for storing both note information and attack information in the same memory circuit and outputting a note signal in the form of binary numbers and an attack trigger signal in accordance with the output from a counter counting constant frequency clock pulses, the counter being directly connected to the memory circuit such that both the note signal and the attack trigger signal are outputted by the same counter, a latch circuit at the output of the memory circuit storing the note signal in response to the attack trigger signal from the memory circuit, means for obtaining a scale signal corresponding to the note signal latched in the latch circuit, an envelope circuit for amplitude controlling the scale signal from the scale signal obtaining means in response to the attack trigger signal, a tone converter for converting the output from the envelope circuit to a tone signal.

5. An automatic accompaniment apparatus comprising a plurality of automatic accompaniment circuits, each composed of a counter for counting constant frequency clocks, a memory circuit for storing both note information and attack information in the same memory circuit and outputting a note signal in the form of binary numbers and an attack trigger signal in accordance with the output from the counter, the counter being directly connected to the memory circuit such that both the note signal and the attack trigger signal are outputted by the same counter, means for obtaining a scale signal corresponding to the note signal from the memory circuit, an envelope circuit for amplitude controlling the scale signal from the scale signal obtaining means with the attack trigger signal, and a tone converter for converting the output from the envelope circuit to a tone signal, a first switching circuit for resetting the counters of the automatic accompaniment circuits in common to them, and second switching circuits, each controlling the supply of the attack trigger signal from the memory circuit to the envelope circuit of each automatic accompaniment circuit.

* * * * *